US007249387B2

(12) United States Patent
Diggins

(10) Patent No.: US 7,249,387 B2
(45) Date of Patent: Jul. 31, 2007

(54) INVALID HOIST

(75) Inventor: Mark Diggins, Bridgend (GB)

(73) Assignee: Days Healthcare UK Limited, Brigend (GB)

( * ) Notice: Subject to any disclaimer, the term of this patent is extended or adjusted under 35 U.S.C. 154(b) by 46 days.

(21) Appl. No.: 11/246,324

(22) Filed: Oct. 7, 2005

(65) Prior Publication Data

US 2006/0075551 A1 Apr. 13, 2006

(30) Foreign Application Priority Data

Oct. 7, 2004 (GB) ..... 0422238.6

(51) Int. Cl.
*A61G 7/10* (2006.01)

(52) U.S. Cl. ..... 5/83.1; 5/87.1

(58) Field of Classification Search ..... 5/81.1 R, 5/83.1, 87.1; 212/237, 260, 901; 254/8 B; 414/921; 188/82.7, 82.8, 181 T
See application file for complete search history.

(56) References Cited

U.S. PATENT DOCUMENTS

| | | | | |
|---|---|---|---|---|
| 5,390,380 | A * | 2/1995 | James-Wallace | 5/84.1 |
| 5,975,499 | A * | 11/1999 | Ostrobrod | 254/332 |
| 6,035,465 | A * | 3/2000 | Rogozinski | 5/83.1 |
| 2006/0075552 | A1 * | 4/2006 | Diggins | 5/81.1 R |

FOREIGN PATENT DOCUMENTS

GB 2034408 A * 6/1980

* cited by examiner

*Primary Examiner*—Michael Trettel
(74) *Attorney, Agent, or Firm*—Skinner and Associates

(57) ABSTRACT

An invalid hoist comprises a support 10, an arm 12 pivotally connected to the support 10, drive means for driving the arm 12 for pivotal movement relative to the support 10, and brake means 18 independent of the drive means to apply a braking force to the arm 12 in the event that movement thereof occurs at a speed grater than a predetermined speed.

7 Claims, 2 Drawing Sheets

INVALID HOIST

This invention relates to a safety device for incorporation into an invalid hoist.

Invalid hoists are commonly used to lift, for example, the elderly or disabled, for example to assist in moving an individual from a bed or chair to a wheelchair. The use of hoists in these applications is becoming increasingly common as it reduces the risk of injury to a carer who would otherwise be manually lifting and moving the patient. It may also reduce the number of carers required to be present to perform such tasks.

A typical hoist design includes an upright mounted upon legs, the legs typically being provided with wheels or castors. Pivotally connected to the upper end of the upright is a bar designed to carry a sling. A drive arrangement, for example of linear motor or hydraulic form, is connected between the upright and the bar to drive the bar for pivotal movement relative to the upright. Some designs of hoist further include a foot plate upon which a user places his feet, and a knee pad against which his knees abut, however a number of hoist designs not including these features are also known.

There is a risk, with such a hoist, that failure of the drive arrangement may allow the bar to fall under the action of gravity. In such circumstances, there is a significant risk of injury to a user being lifted, either resulting from the bar striking the user or from the user being allowed to fall to the floor or onto another object. There is a further risk of injury to a carer operating the hoist. It is an object of the invention to provide a hoist in which the risk of such injury is reduced.

According to the invention there is provided an invalid hoist comprising a support, an arm pivotally connected to the support, drive means for driving the arm for pivotal movement relative to the support, and brake means independent of the drive means to apply a braking force to the arm in the event that movement thereof occurs at a speed greater than a predetermined speed.

In such an arrangement, in the event of failure of the drive means and the arm falling under the action of gravity, once a predetermined speed has been reached the brake will apply a braking load to the arm, slowing or preventing further movement of the arm. As a result, the risk of injury to a user, carer or individual close to the hoist can be reduced.

The brake means is conveniently inertia operated.

Preferably the brake means includes a component rotatable upon pivoting movement of the bar, the component carrying a moveable projection moveable, under the action of centrifugal force upon the component rotating at a speed exceeding a predetermined speed, into engagement with an associated abutment.

Preferably the brake means is only operable during lowering movement of the arm.

The invention will further be described, by way of example, with reference to the accompanying drawings, in which.

Figure 1:
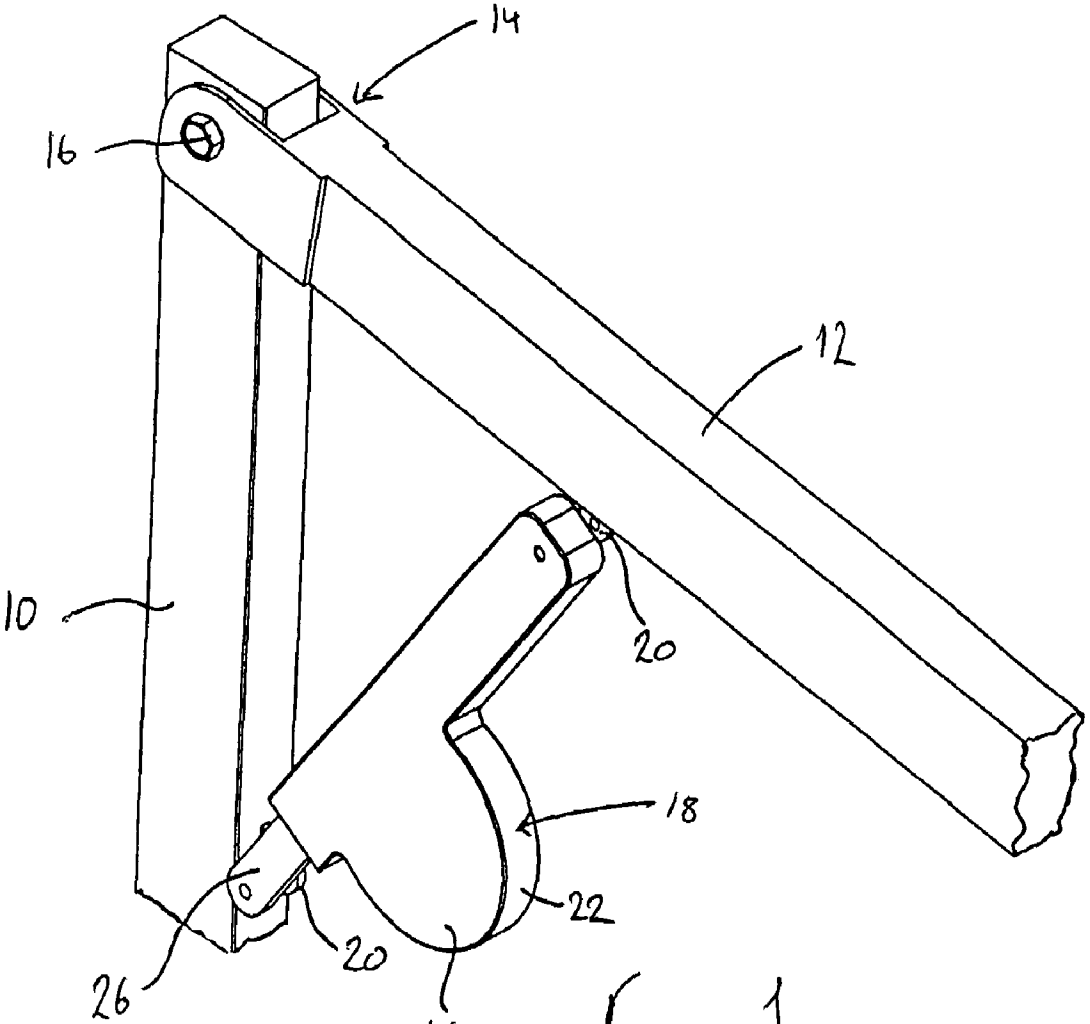
FIG. 1 illustrates part of an invalid hoist.

The invalid hoist illustrated in the accompanying drawings comprises a support in the form of an upright or mast 10 to which is pivotally mounted a bar 12. Although a wide range of pivotal connections between the upright 10 and the bar 12 are possible, in the illustrated arrangement the pivotal connection is of relatively simple form, the bar 12 being provided with a forked end region 14, a bolt 16 extending through aligned openings in the forked end region 14 of the bar 12 and in the upright 10. Although not illustrated, a drive arrangement, for example in the form of a linear actuator, is provided to drive the arm 12 for pivotal movement relative to the support 10.

As is usual with invalid hoists, the upright 10 is mounted upon a pair of legs, the legs being supported by wheels or castors. Depending upon the type of hoist, a foot support plate and knee pad may also be provided.

The bar 12 is provided, at its end remote from its pivotal connection to the upright 10, with features to allow the mounting thereto of a sling or other suitable device for use in supporting a user.

In accordance with the invention, a brake 18 is provided, the brake 18 being connected to mountings 20 provided on the upright 10 and bar 12.

Figure 2:
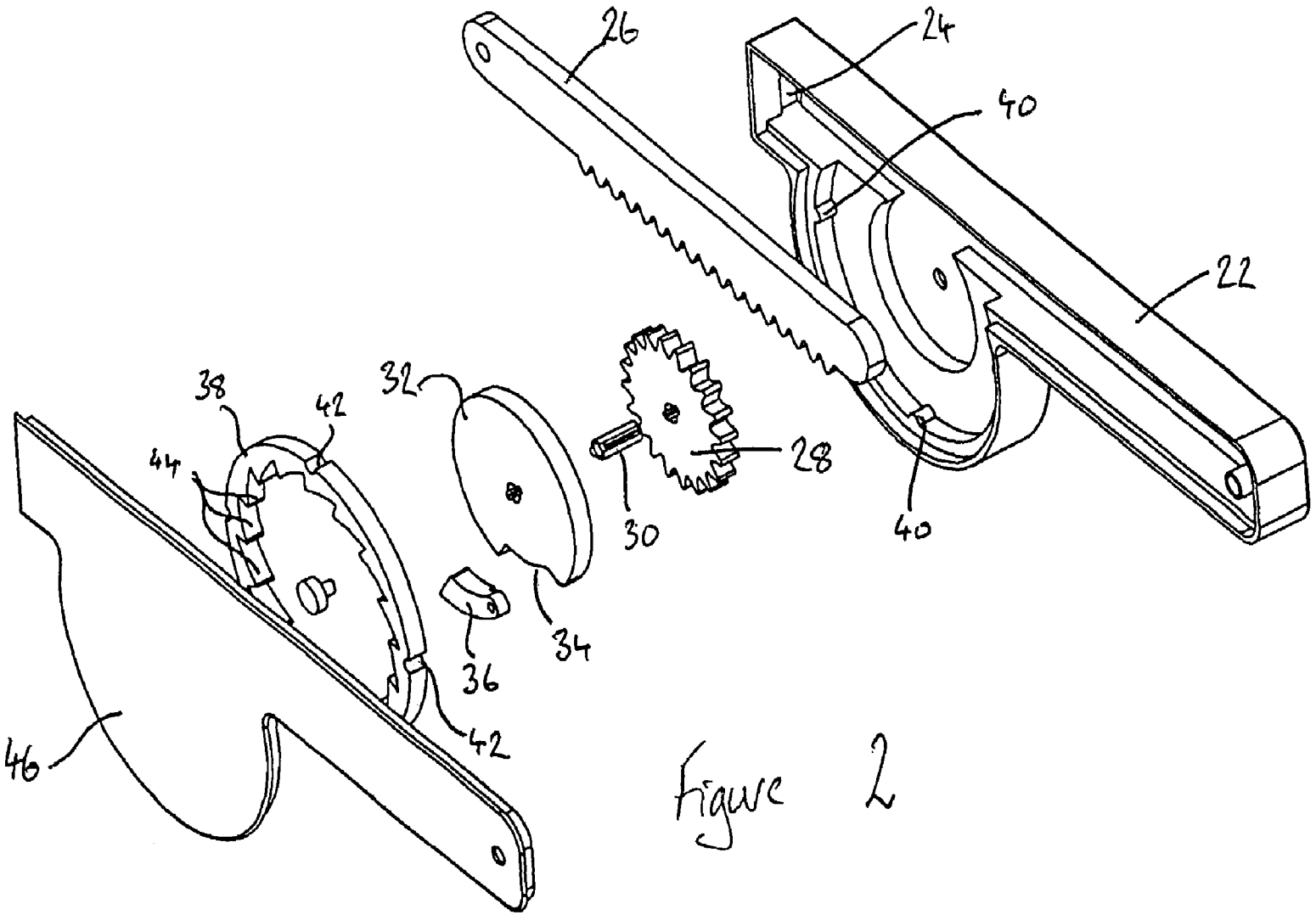
FIG. 2 is an exploded view illustrating a brake means for the hoist.

As shown in FIG. 2, the brake arrangement 18 comprises a housing part 22 arranged to be pivotally connected, at one end, to one of the mountings 20. At the other end of the housing part 22 is provided a slot 24 through which a toothed rack 26 extends, the rack 26 being adapted to be pivotally mounted to the other of the mountings 20.

Within the housing part 22 is located a toothed wheel 28, the teeth of which co-operate with the teeth of the rack 26 such that, upon pivoting movement of the arm 12 relative to the upright 10, the rack 26 is either pushed further into the housing part 22 or retracted from the housing part 22 causing rotation of the toothed wheel 28.

The toothed wheel 28 is connected by a spline member 30 to a rotatable component 32. The rotatable component 32 is provided with a recess 34 within which is located a moveable projection 36. The projection 36 is pivotally connected to the component 32 so as to be moveable between a retracted position in which it lies substantially wholly within the recess 34 and an extended position in which it projects from the recess 34.

The component 32 and projection 36 are located within the opening of an annular abutment component 38 which is held against rotation within the housing by projections 40 which are received within recesses 42 provided in the outer periphery of the abutment member 38. The inner periphery of the abutment member 38 is shaped to define a series of ramped teeth-like abutments 44 with which the projection 36 is engageable when the projection 36 is in its extended position.

A closure member 46 is provided to close the housing part 22.

In use, when the motor or drive arrangement is used to raise the arm 12, the movement of the arm 12 relative to the upright 10 will cause the rack 26 to be withdrawn from the housing part 22. The withdrawal of the rack 26 in this manner causes rotation of the toothed wheel 28 and component 32. Due to the orientation of the abutments 44 and projection 36, rotary movement of the component 32 in this direction is not impeded regardless as to how fast the arm 12 is raised. Further, should the projection 36 occupy its extended position, the projection 36 will ride up the ramped surfaces of the abutments 44 and thereby be moved to its retracted position.

If the arm 12 is lowered using the drive arrangement, then provided the rate of lowering is relatively low, the centrifugal forces experienced by the projection 36 will be insufficient to cause the projection 36 to move out of the recess 34. As a result, lowering of the arm 12 is permitted without the projection 36 engaging the abutments 44. However, if the arm 12 is lowered at a rate exceeding a predetermined rate, for example due to the failure of the drive arrangement, then the rack 26 will be pushed into the housing part 22 at a sufficiently fast rate that the component 32 is rotated at a speed sufficient to cause the projection 36 to move out of the recess 34 to its extended position due to the centrifugal forces experienced by the projection 36. Such movement of the projection 36 will result in the projection 36 engaging one of the abutments 44 of the abutment member 38. Such engagement prevents further movement of the component 32 which in turn prevents the rack 26 being pushed further into the housing part 22 thereby preventing further lowering of the arm 12. By preventing the arm 12 from being lowered further under such circumstances, the risk of injury to a user of the hoist, a carer or other individual located adjacent the hoist can be reduced.

If the brake arrangement 18 is actuated to prevent further lowering of the arm 12, re-setting of the brake arrangement can be achieved by lifting the arm 12, either manually or using the drive arrangement, such lifting causing rotation of the component 32 in a direction in which the projection 36 rides up the abutments 44, urging the projection 36 back into the recess 34 such that subsequent lowering of the arm 12 in a controlled manner does not result in the projection 36 engaging the abutments 44.

In the illustrated embodiment, a fairly large number of abutments 44 are provided with the result that the brake stops the arm 12 quickly. It will be appreciated, however, that more or fewer abutments 44 may be provided. Further, one or more additional projections 36 may be associated with the component 32, if desired.

It will be appreciated that a range of modifications and alterations to the arrangement described hereinbefore are possible without departing from the scope of the invention.

The invention claimed is:

1. An invalid hoist comprising a support, an arm pivotally connected to the support, drive means for driving the arm for pivotal movement relative to the support, and brake means independent of the drive means to apply a braking force to the arm in the event that movement thereof occurs at a speed greater than a predetermined speed, wherein the brake means is inertia operated.

2. A hoist according to claim 1, wherein the brake means includes a component rotatable upon pivoting movement of the bar, the component carrying a movable projection movable, under the action of centrifugal force upon the component rotating at a speed exceeding a predetermined speed, into engagement with an associated abutment.

3. A hoist according to claim 2, further comprising a rack associated with one of the support and the arm and a toothed wheel associated with the other of the support and the arm, relative movement between the support and the arm causing the rack to drive the toothed wheel.

4. A hoist according to claim 1, wherein the brake means is only operable during lowering movement of the arm.

5. An invalid hoist comprising a support, an arm pivotally connected to the support, drive means for driving the arm for pivotal movement relative to the support, and brake means independent of the drive means to apply a braking force to the arm in the event that movement thereof occurs at a speed greater than a predetermined speed, wherein the brake means includes a component rotatable upon pivoting movement of the bar, the component carrying a movable projection movable, under the action of centrifugal force upon the component rotating at a speed exceeding a predetermined speed, into engagement with an associated abutment.

6. A hoist according to claim 5, further comprising a rack associated with one of the support and the arm and a toothed wheel associated with the other of the support and the arm, relative movement between the support and the arm causing the rack to drive the toothed wheel.

7. A hoist according to claim 5, wherein the brake means is only operable during lowering movement of the arm.

* * * * *